US006357526B1

(12) United States Patent
Abdel-Halim et al.

(10) Patent No.: US 6,357,526 B1
(45) Date of Patent: Mar. 19, 2002

(54) FIELD UPGRADING OF HEAVY OIL AND BITUMEN

(75) Inventors: Tayseer Abdel-Halim, The Woodlands; Murugesan Subramanian, Houston, both of TX (US)

(73) Assignee: Kellogg Brown & Root, Inc., Houston, TX (US)

( * ) Notice: Subject to any disclaimer, the term of this patent is extended or adjusted under 35 U.S.C. 154(b) by 0 days.

(21) Appl. No.: 09/527,299

(22) Filed: Mar. 16, 2000

(51) Int. Cl.[7] ..... E21B 43/24

(52) U.S. Cl. ..... 166/272.3; 166/267; 166/279; 166/310; 166/75.12; 208/309; 208/45

(58) Field of Search ..... 166/267, 268, 166/272.1, 272.3, 272.7, 279, 310, 75.12; 208/309, 45

(56) References Cited

U.S. PATENT DOCUMENTS

| | | | | |
|---|---|---|---|---|
| 4,875,998 A | * | 10/1989 | Rendall | 208/390 |
| 5,046,559 A | | 9/1991 | Glandt | |
| 5,083,613 A | * | 1/1992 | Gregoli et al. | 166/275 |
| 5,192,421 A | * | 3/1993 | Audeh et al. | 208/309 |
| 5,215,146 A | | 6/1993 | Sanchez | |
| 5,318,124 A | | 6/1994 | Ong et al. | |
| 6,016,868 A | * | 1/2000 | Gregoli et al. | 166/261 |
| 6,241,874 B1 | * | 6/2001 | Wallace et al. | 208/45 |
| 6,274,032 B2 | * | 8/2001 | Hood et al. | 208/309 |

FOREIGN PATENT DOCUMENTS

CA 2069515 11/1993

OTHER PUBLICATIONS

Good, W.K., Shell/AOSTRA Peace River Horizontal Well Demonstration Project, A test of the Enhanced Stream Assisted Gravity Drainage Process; Conference on Heavy Crude and Tar Sands; 1995.

* cited by examiner

*Primary Examiner*—David Bagnell
*Assistant Examiner*—Zakiya Walker
(74) *Attorney, Agent, or Firm*—Kellogg Brown & Root, Inc.

(57) ABSTRACT

A process and system which integrates on-site heavy oil or bitumen upgrading and energy recovery for steam production with steam-assisted gravity drainage (SAGD) production of the heavy oil or bitumen. The heavy oil or bitumen produced by SAGD is flashed to remove the gas oil fraction, and the residue is solvent deasphalted to obtain deasphalted oil, which is mixed with the gas oil fraction to form a pumpable synthetic crude. The synthetic crude has an improvement of 4–5 degrees of API and lower in sulfur, nitrogen and metal compounds. The synthetic crude is not only more valuable than the heavy oil or bitumen, but also has substantial economic advantage of reducing the diluent requirement since it has lower viscosity than the heavy oil or bitumen. The asphaltenes, following an optional pelletizing and/or slurrying step, are used as a fuel for combustion in boilers near the steam injection wells for injection into the heavy oil or bitumen reservoir. This eliminates the need for natural gas or other fuel to produce steam at reservoir location and thus improves the economics of the heavy oil or bitumen production substantially. Alternatively, the asphaltenes are used as a feedstock for gasification to produce injection steam, synthesis gas. The $CO_2$ could be used as additive with injection steam to enhance the performance of SAGD and the hydrogen could be exported to nearby processing facility. The invention upgrades the heavy oil or bitumen to a synthetic crude of improved value that can be pipelined with reduced amount of diluent, while at the same time using the asphaltene fraction of the residue for combustion to fulfill the energy requirements for generating injection steam for SAGD.

29 Claims, 6 Drawing Sheets

FIELD UPGRADING OF HEAVY OIL AND BITUMEN

FIELD OF THE INVENTION

This invention relates to recovering a pumpable crude oil from a reservoir of heavy oil or bitumen by the steam-assisted gravity drainage (SAGD) process, and more particularly to solvent deasphalting to remove an asphaltene fraction from the heavy oil or bitumen to yield the pumpable synthetic crude, and to combusting the asphaltene fraction to supply heat for generation of the injection steam.

BACKGROUND

Heavy oil reservoirs contain crude petroleum having an API gravity less than about 10 which is unable to flow from the reservoir by normal natural drive primary recovery methods. These reservoirs are difficult to produce due to very high petroleum viscosity and little or no gas drive. Bitumen, usually as tar sands, occur in many places around the world.

The steam-assisted gravity drainage (SAGD) process is commonly used to produce heavy oil and bitumen reservoirs. This generally involves injection of steam into an upper horizontal well through the reservoir to generate a steam chest that heats the petroleum to reduce the viscosity and make it flowable. Production of the heavy oil or bitumen is from a lower horizontal well through the reservoir disposed below the upper horizontal well.

Representative references directed to the production of crude petroleum from tar sands include Canadian Patent Application 2,069,515 by Kovalsky; U.S. Pat. No. 5,046,559 to Glandt; U.S. Pat. No. 5,318,124 to Ong et al; U.S. Pat. No. 5,215,146 to Sanchez; and Good, "Shell/Aostra Peace River Horizontal Well Demonstration Project," 6$^{th}$ UNITAR Conference on Heavy Crude and Tar Sands (1995), all of which are hereby incorporated herein by reference. Most of this technology has been directed to improving reservoir production characteristics. Surprisingly, very little attention has been directed to incorporating on-site downstream processing into the upstream field processing of the heavy oil or bitumen for improving the efficiency of operation and overall field production economy.

The heavy oil or bitumen produced by the SAGD and similar methods requires large amounts of steam generated at the surface, typically at a steam-to-oil ratio (SOR) of 2:1, i.e. 2 volumes of water have to be converted to injection steam for each volume of petroleum that is produced. Usually natural gas is used as the fuel source for firing the steam boilers. It is very expensive to supply the natural gas to the boilers located near the injection wells, not to mention the cost of the natural gas itself.

Another problem is that when the heavy oil or bitumen is produced at the surface, it has a very high viscosity that makes it difficult to transport and store. It must be kept at an elevated temperature to remain flowable, and/or is sometimes mixed with a lighter hydrocarbon diluent for pipeline transportation. The diluent is expensive and additional cost is incurred to transport it to the geographically remote location of the production. Furthermore, aspahaltenes frequently deposit in the pipelines through which the diluent/petroleum mixture is transported.

There is an unmet need in the art for a way to reduce the cost of steam generation and the cost and problems associated with heavy oil and/or bitumen surface processing and transporting. The present invention is directed to these unfulfilled needs in the art of SAGD and similar heavy oil and/or bitumen production.

SUMMARY OF THE INVENTION

The present invention provides a process and systems for producing heavy oil or bitumen economically by steam-assisted gravity drainage (SAGD), upgrading the heavy oil or bitumen into a synthetic crude, and using the bottom of the barrel to produce steam for injection into the reservoir.

Broadly, the present invention provides a process for recovering a pumpable synthetic crude oil from a subterranean reservoir of heavy oil or bitumen, comprising the steps of: (a) injecting steam through at least one injection well completed in communication with the reservoir to mobilize the heavy oil or bitumen; (b) producing the mobilized heavy oil or bitumen from at least one production well completed in the reservoir; (c) fractionating the heavy oil or bitumen produced from step (b) at a location adjacent to the reservoir into a first fraction as a minor amount of the heavy crude comprising a gas oil fraction and second fraction comprising a residue; (d) solvent deasphalting the second fraction from step (c) to form an asphaltene fraction and a deasphalted oil fraction essentially free of asphaltenes; (e) combusting the asphaltene fraction from step (d) to produce the steam for injection step (a); and (e) blending the first fraction from step (c) with the deasphalted oil fraction from step (d) to form a pumpable synthetic crude oil. The fractionation is preferably performed under atmospheric pressure. The asphaltene fraction from step (d) can be supplied as a liquid to the combustion step (e), or alternatively the asphaltene fraction from step (d) can be pelletized to obtain asphaltene pellets for supply to the combustion step (e).

The combustion step (e) preferably comprises combustion of the asphaltenes in a boiler to produce the injection steam for step (a). By this process, the solvent deasphalting step (d) can be performed at a first location to which the produced heavy oil or bitumen is transported, and the asphaltene fraction can be transported from the first location to a plurality of boilers spaced away from the first location, preferably adjacent to the injection well or wells. The boiler is preferably a circulating fluid bed boiler.

In an alternate embodiment, the combustion step (e) comprises gasification of the asphaltene fraction to produce a synthesis gas and the injection steam for step (a). The process can include recovering $CO_2$ from the synthesis gas and injecting the $CO_2$ into the reservoir. A portion of the steam produced from gasification can be expanded in a turbine to generate electricity.

Another aspect of the invention is a process for recovering a pumpable crude oil from a subterranean reservoir of heavy oil or bitumen. The process comprises the steps of: (a) injecting steam through one or more injection wells completed in communication with the reservoir to mobilize the heavy oil or bitumen; (b) producing the mobilized heavy oil or bitumen from at least one production well completed in the reservoir; (c) solvent deasphalting at least a portion of the heavy oil or bitumen produced from step (b) to form an asphaltene fraction and a deasphalted oil fraction essentially free of asphaltenes; (d) pelletizing the asphaltene fraction from step (c) to obtain asphaltene pellets; and (e) combusting the asphaltene pellets from step (d) to produce the steam for injection step (a). The combustion step (e) in one embodiment comprises combustion in at least one boiler to produce the injection steam for step (a). In one embodiment, the solvent deasphalting step (d) is preferably performed at a first location and the asphaltene fraction is transported from the first location to a plurality of boilers spaced away from the first location adjacent to the one or more injection wells. The at least one boiler is preferably a circulating fluid bed boiler. In an alternate embodiment, the combustion step (e) comprises gasification of the asphaltene pellets to produce a synthesis gas and the injection steam for step (a). The process can include the steps of recovering $CO_2$ from the synthesis gas and injecting the $CO_2$ into the reservoir with the steam. A portion of the steam generated from gasification can be expanded in a turbine to generate electricity.

Another aspect of the invention is the provision of a system for producing a pumpable synthetic crude oil. The system includes a subterranean reservoir of heavy oil or bitumen; at least one injection well completed in the reservoir for injecting steam into the reservoir to mobilize the heavy oil or bitumen; at least one production well completed in the reservoir for producing the mobilized heavy oil or bitumen; an atmospheric flash unit for fractionating the heavy oil or bitumen produced from the at least one production well into a minor portion comprising a gas oil fraction and a major portion comprising a residue fraction; a solvent deasphalting unit for separating the residue fraction into a minor portion comprising an asphaltene fraction and a major portion comprising a deasphalted oil fraction essentially free of asphaltenes; mixing apparatus for mixing the gas oil fraction and the deasphalted oil fraction to form a pumpable synthetic crude; a pelletizer for palletizing the asphaltene fraction into solid pellets; at least one boiler for combustion of the asphaltene pellets to generate the injection steam; and at least one line for supplying the steam from the at least one boiler to the at least one injection well.

A further aspect of the invention is the provision of a process for recovering a pumpable crude oil from a subterranean reservoir of heavy oil or bitumen. The process comprises the steps of: (a) injecting steam through one or more injection wells completed in communication with the reservoir to mobilize the heavy oil or bitumen; (b) producing the mobilized heavy oil or bitumen from at least one production well completed in the reservoir; (c) solvent deasphalting a first portion of the heavy oil or bitumen at a location adjacent to the reservoir to form an asphaltene fraction and a deasphalted oil fraction essentially free of asphaltenes; (d) combusting the asphaltene fraction from step (c) to produce the steam for injection step (a); (e) blending a second portion of the heavy oil or bitumen with the deasphalted oil fraction from step (c) to form a pumpable synthetic crude oil; and (g) pipelining the synthetic crude oil to a location remote from the reservoir.

In another aspect, the present invention provides a system for producing a pumpable synthetic crude oil. The system includes a subterranean reservoir of heavy oil or bitumen, at least one injection well completed in the reservoir for injecting steam into the reservoir to mobilize the heavy oil or bitumen, and at least one production well completed in the reservoir for producing the mobilized heavy oil or bitumen. An atmospheric flash unit is used to fractionate the heavy oil or bitumen produced from the production well into a minor portion comprising a light gas oil fraction and a major portion comprising a residue fraction. A solvent deasphalting unit separates the residue fraction into a minor portion comprising an asphaltene fraction and a major portion comprising a deasphalted oil fraction essentially free of asphaltenes. A mixing apparatus is provided for mixing the light gas oil fraction and the deasphalted oil fraction to form a pumpable synthetic crude. A boiler burns the asphaltene fraction as fuel to generate the injection steam. A line supplies the steam from the boiler to the injection well or wells.

The system can include a line for supplying the asphaltene fraction in liquid form to the boiler. Alternatively, a pelletizer unit can be used to form the asphaltene into solid pellets. The pelletizer unit preferably comprises: (1) an upright pelletizing vessel having an upper prilling zone, a sphere-forming zone below the prilling zone, a cooling zone below the sphere-forming zone, and a lower aqueous cooling bath below the cooling zone; (2) a centrally disposed prilling head in the prilling zone rotatable along a vertical axis and having a plurality of discharge orifices for throwing asphaltene radially outwardly, wherein a throw-away diameter of the prilling head is less than an inside diameter of the pelletizing vessel; (3) a line for supplying the asphaltene fraction in liquid form to the prilling head; (4) a vertical height of the sphere-forming zone sufficient to allow asphaltene discharged from the prilling head to form substantially spherical liquid pellets; (5) nozzles for spraying water inwardly into the cooling zone to cool and at least partially solidify the liquid pellets to be collected in the bath; (6) a line for supplying water to the nozzles and the bath to maintain a depth of the bath in the pelletizing vessel; (7) a line for withdrawing a slurry of the pellets in the bath water; and (8) a liquid-solid separator for dewatering the pellets from the slurry.

The atmospheric fractionator unit, the solvent deasphalting unit and the pelletizer are preferably centrally located with a plurality of the boilers located away from the central location adjacent to injection wells.

In an alternate embodiment of the heavy oil or bitumen production system, a slurrying unit is used for pelletizing the asphaltene fraction and forming an aqueous slurry which is supplied to a gasification unit for partial oxidation of the slurry to form a synthesis gas and generating the steam. A line supplies the steam from the gasification unit to the injection well or wells. The slurrying unit can include: (1) an upright prilling vessel having an upper prilling zone, a hot discharge zone below the prilling zone, a cooling zone below the discharge zone, and a lower cooling bath below the cooling zone; (2) a centrally disposed prilling head in the prilling zone rotatable along a vertical axis and having a plurality of discharge orifices for throwing asphaltene radially outwardly, wherein a throw-away diameter of the prilling head is less than an inside diameter of the prilling vessel; (3) a line for supplying a hot, liquid asphaltene stream comprising the asphaltene fraction to the prilling head; (4) a vertical height of the discharge zone sufficient to allow asphaltene discharged from the prilling head to form into liquid droplets; (5) nozzles for spraying water inwardly into the cooling zone to cool and at least partially solidify the liquid droplets to be collected in the bath and form a slurry of solidified asphaltene particles in the bath; (6) a line for supplying water to the nozzles and the bath to maintain a depth of the bath in the prilling vessel; and (7) a line for withdrawing the slurry of the asphaltene particles in the bath water from the prilling vessel. The slurrying unit can also include a liquid-solid separator such as a vibrating screen for dewatering pellets from the slurry.

In the gasification system, the atmospheric fractionator unit, the solvent deasphalting unit, the slurrying unit and the gasification unit are preferably centrally located with a plurality of the steam supply lines carrying steam to a plurality of the injection wells located away from the central location. $CO_2$ can also be generated by and recovered from the gasification unit, and a line or lines can supply the $CO_2$ from the gasification unit to at least one of the injection wells. A turbine can also be used for expanding a portion of the steam generated by the gasification unit to generate electricity.

DETAILED DESCRIPTION

The present invention integrates heavy oil or bitumen upgrading to a pumpable crude with the production of asphaltenes for fuel to generate the steam used for injection into the heavy oil or bitumen reservoir. This has the substantial economic advantage of eliminating the need to bring natural gas or other fuel to the location of the reservoir for steam generation. At the same time, the heavy oil or bitumen is upgraded by removing the asphaltene fraction, which also contains a substantial portion of the sulfur, nitrogen and metal compounds, thereby producing a synthetic crude that can have an improvement of 4–5 degrees of API, or more. The synthetic crude is not only more valuable than the heavy oil or bitumen, but also has the further substantial economic advantage of eliminating the need for diluent since it has a lower viscosity than the heavy oil or bitumen and is pumpable through a pipeline.

Figure 1:
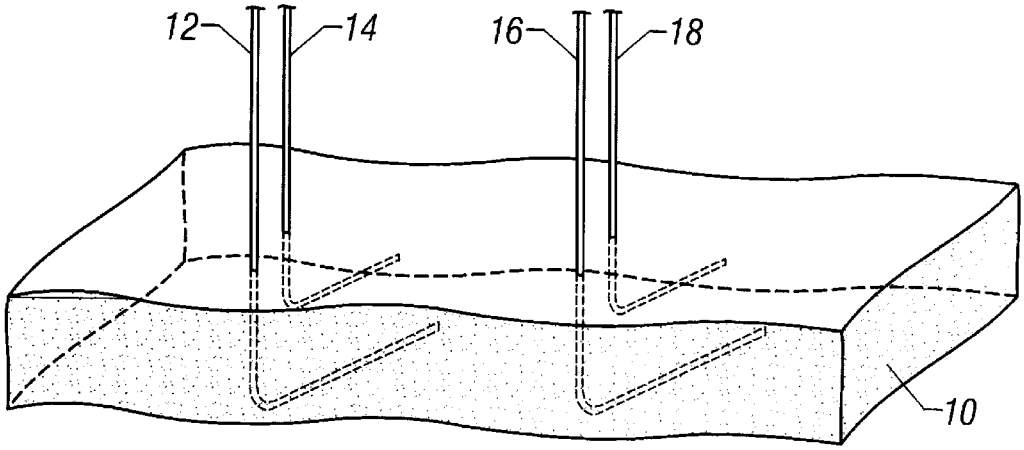
FIG. 1 is a schematic perspective view of an underground heavy oil or bitumen reservoir with two pairs of wells.
Figure 2:
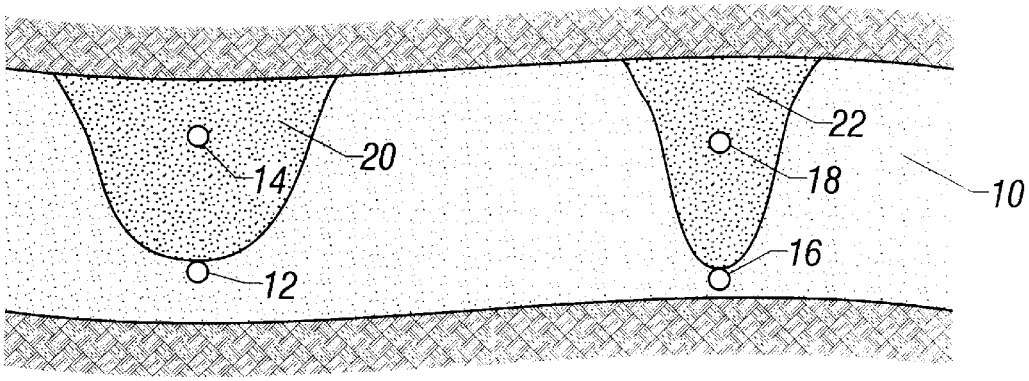
FIG. 2 is a schematic vertical cross-sectional view of the underground heavy oil or bitumen reservoir of FIG. 1.

With reference to FIGS. 1 and 2, wherein like numerals are used in reference to like parts, a subterranean heavy oil or bitumen reservoir 10 is located below the surface of an overlying layer (not shown). Wells 12,14,16,18 are conventionally completed horizontally in the reservoir 10 according to techniques well-known in the art. Upper wells 14,18 are used as steam injection wells, and wells 12,16 are used as production wells. Initially, the heavy oil or bitumen in the reservoir 10 is not flowable. Flowable zones or paths are created between wells 14,18 and wells 12,16, respectively, by circulating steam through upper injection wells 14,18 and performing alternate steam injection and fluid production in the lower wells 12,16, a well-known procedure known in the art as steam soak, or huff and puff. When a flowable path has been created between the injection wells 14,18 and the production wells 12,16, the steam injection into the production wells 12,16 is generally stopped, and production thereafter occurs according to steam-assisted gravity drainage (SAGD). Steam chests 20,22 (see FIG. 2) are allowed to build up and expand as steam is injected into the reservoir 10 through wells 14,18 as the heavy oil or bitumen is displaced from the reservoir 10 by gravity drainage to the production wells 12,16.

The production can be enhanced, if desired, by using well-known techniques such as injecting steam into one of the wells 14,18 at a higher rate than the other, applying electrical heating of the reservoir 10, employing solvent $CO_2$ as an additive to the injection steam mainly to enhance its performance, thus improving the SAGD performance. The particular SAGD production techniques which are employed in the present invention are not particularly critical, and can be selected to meet the production requirements and reservoir characteristics as is known in the art.

The heavy oil or bitumen and steam and/or water produced from the formation 10 through production wells 12,16 is passed through a conventional water-oil separator (not shown) which separates the produced fluids to produce a heavy oil or bitumen stream 30 (see FIG. 3) essentially free of water, while generally keeping the heavy oil or bitumen at a temperature at which it remains flowable. The heavy oil or bitumen stream 30 is split into two portions, a first portion diverted into stream 32 and a second portion 34 which is supplied to solvent deasphalting unit 36. The solvent deasphalting unit 36 can be conventional, employing equipment and methodologies for solvent deasphalting which are widely available in the art, for example, under the trade designations ROSE, SOLVAHL, DEMEX, or the like. Preferably, a ROSE unit 58 (see FIG. 6) is employed, as discussed in more detail below. The solvent deasphalting unit 36 separates the heavy oil or bitumen into an asphaltene-rich fraction 40 and a deasphalted oil (DAO) fraction 42, which is essentially free of asphaltenes. By selecting the appropriate operating conditions of the solvent deasphalting unit 36, the properties and contents of the asphaltenes fraction 40 and the DAO fraction 42 can be adjusted.

The DAO fraction 42 is blended in mixing unit 43 with the heavy oil or bitumen from stream 32 to form a mixture of DAO and heavy oil or bitumen supplied downstream via pipeline 44. The mixing can occur in line, with or without a conventional in-line mixer, or in a mixing vessel which is agitated or recirculated to achieve blending. The split of heavy oil or bitumen between stream 32 and second portion 34 should be such that the DAO/heavy oil or bitumen blend resulting in line 44 is pumpable, i.e. having a sufficiently low viscosity at the pipeline temperatures so as to not require hydrocarbon diluent, and preferably also does not require heating of the line 44. The blend preferably has a viscosity at 19° C. less than 350 cSt, more preferably less than 300 cSt. For example, if the heavy oil or bitumen 30 produced at the surface has a relatively high viscosity, the amount of the second portion 34 can be increased so as to produce more of DAO fraction 42 so that the resulting blend has a lower viscosity. Similarly, the distribution of asphaltenes/DAO between asphaltene fraction 40 and DAO fraction 42 can be adjusted by changing the operating parameters of the deasphalting unit 36 to produce more or less of asphaltene fraction 40 and/or DAO fraction 42 and a correspondingly higher or lower quality (lower or higher viscosity) DAO fraction 42. Typically, the asphaltene fraction 40 is about 10–30 weight percent of the heavy oil or bitumen 34, but can be more or less than this depending on the characteristics of the heavy oil or bitumen 34 and the operating parameters of the solvent deasphalting unit 36.

The asphaltene fraction 40 is supplied to a boiler 46 either as a neat liquid or as a pelletized solid. Where the asphaltene fraction 40 is a liquid, it may be necessary to use heated transfer lines and tanks to maintain the asphaltene in a liquid state, and/or to use a hydrocarbon diluent. The asphaltene fraction 40 is preferably pelletized in pelletizing unit 48, which can be any suitable pelletizing equipment known for this purpose in the art. The asphaltene pellets can be transported in a dewatered form by truck, bag, conveyor, hopper car, or the like, to boiler 46, or can be slurried with water and transferred via a pipeline. The boiler 46 can be any lo conventionally designed boiler according any suitable type known to those skilled in the art, but is preferably a circulating fluid bed (CFB) boiler, which burns the asphaltene fraction 40 to generate steam for reinjection to wells 14,18 via line 50. The quantity of asphaltenes 40 can be large enough to supply all of the steam requirements for the SAGD heavy oil or bitumen production. Thus, the need for importing fuel for steam generation is eliminated, resulting in significant economy in the heavy oil or bitumen production. Alternatively, a plurality of boilers 46 can be advantageously used by locating each boiler in close proximity to one or more injection wells 14,18 so as to minimize high pressure steam pipeline distances. Any excess steam generation can be used to generate electricity or drive other equipment using a conventional turbine expander.

During startup, it may be desirable to import asphalt pellets, natural gas or other fuel to fire the boiler 46 until the asphaltene fraction 40 is sufficient to meet the fuel requirements for steam generation. Startup may also entail the generation of steam 50 by boiler 46 in sufficient quantities to supply additional steam requirements for injection into wells 12,16 during the huff and puff stage of the reservoir 10 conditioning.

Figure 4:
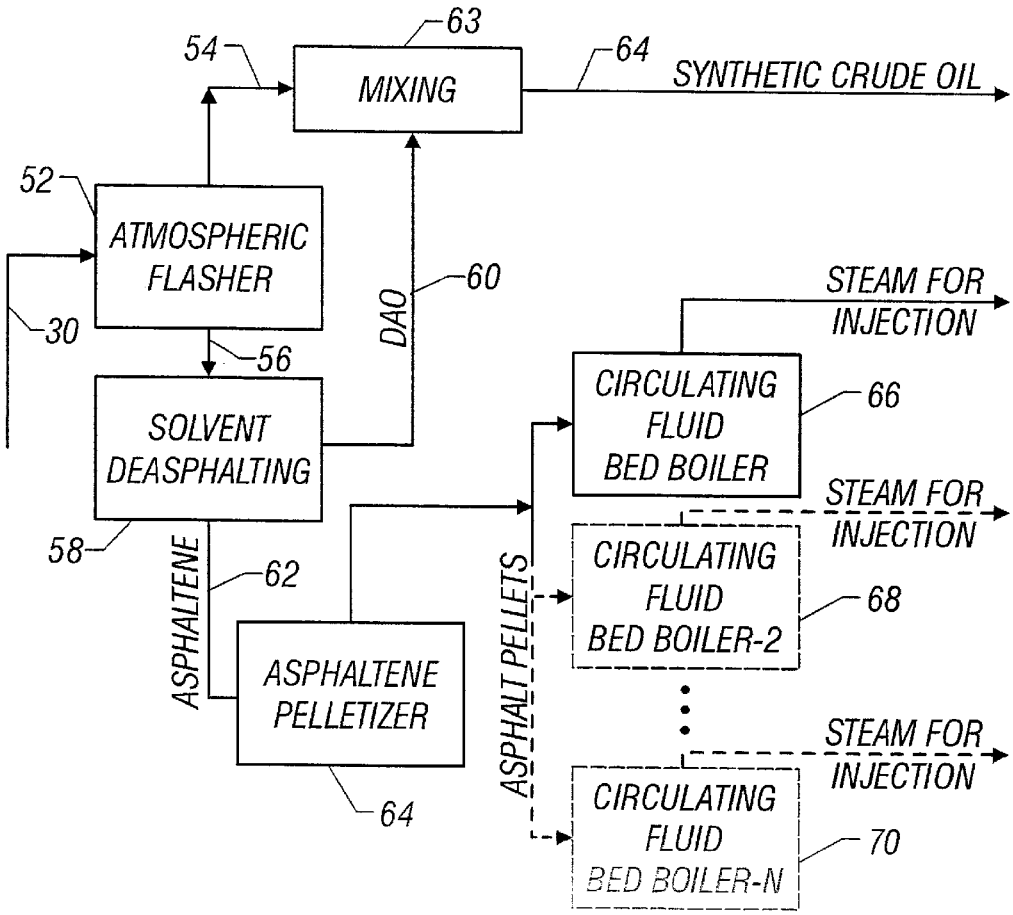
FIG. 4 is a schematic flow diagram of a heavy oil or bitumen production and processing scheme with steam generation for reinjection into the underground heavy oil or bitumen reservoir according to an alternate embodiment of the invention with distributed asphaltene combustion.

Referring to FIG. 4, there is shown an alternate embodiment wherein the produced heavy oil or bitumen 30 is separated in flash unit 52, which is preferably operated essentially at atmospheric pressure to produce atmospheric gas oil fraction 54 and residue 56. The gas oil fraction 54 preferably consists of hydrocarbons from the heavy oil or bitumen 30 with a boiling range below about 650° F., and the residue 56 comprises hydrocarbons with a higher boiling range. Typically, the gas oil fraction 54 is about 10–20 weight percent of the heavy oil or bitumen 30, but can be more or less than this, depending on the characteristics of the heavy oil or bitumen 30 and the temperature and pressure of the flash unit 52. Atmospheric flash unit 52 is conventionally designed, and can be a simple single-stage unit, or it can have one or more trays or packing in a multi-stage tower, with or without reflux. The gas oil fraction 54 has a relatively lower viscosity than the residue 56.

The ROSE unit 58 separates the residue 56 into DAO stream 60 and asphaltenes stream 62 as described elsewhere herein. The DAO stream 60 is blended in mixing unit 63 with the gas oil fraction 54 to yield a blend in line 64 which is a pumpable synthetic crude with a reduced sulfur and metal content by virtue of the fact that the residue has been separated from the gas oil fraction 54 and the asphaltenes separated from the DAO stream 60. The blend thus has higher value as an upgraded product. The asphaltene fraction 62 is pelletized in a centralized pelletizing unit 64 as before, but is supplied to a plurality of boilers 66,68,70 which are each located in close proximity to the injection wells to facilitate steam injection.

Figure 3:
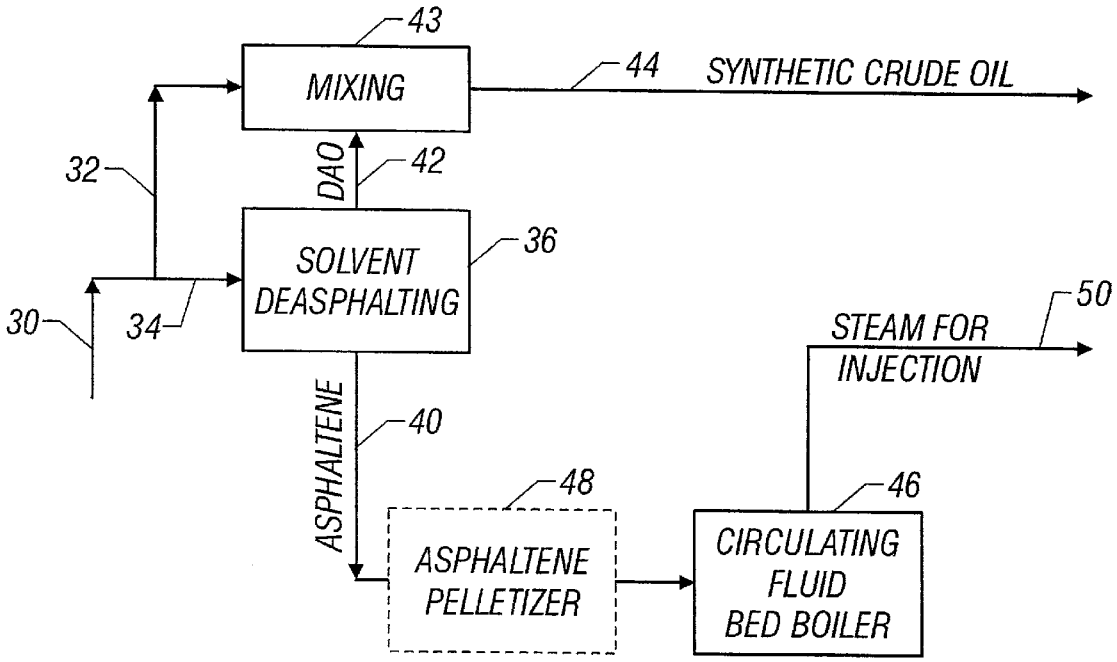
FIG. 3 is a schematic flow diagram of a heavy oil or bitumen production and processing scheme with steam generation for reinjection into the underground heavy oil or bitumen reservoir according to one embodiment of the invention.
Figure 5:
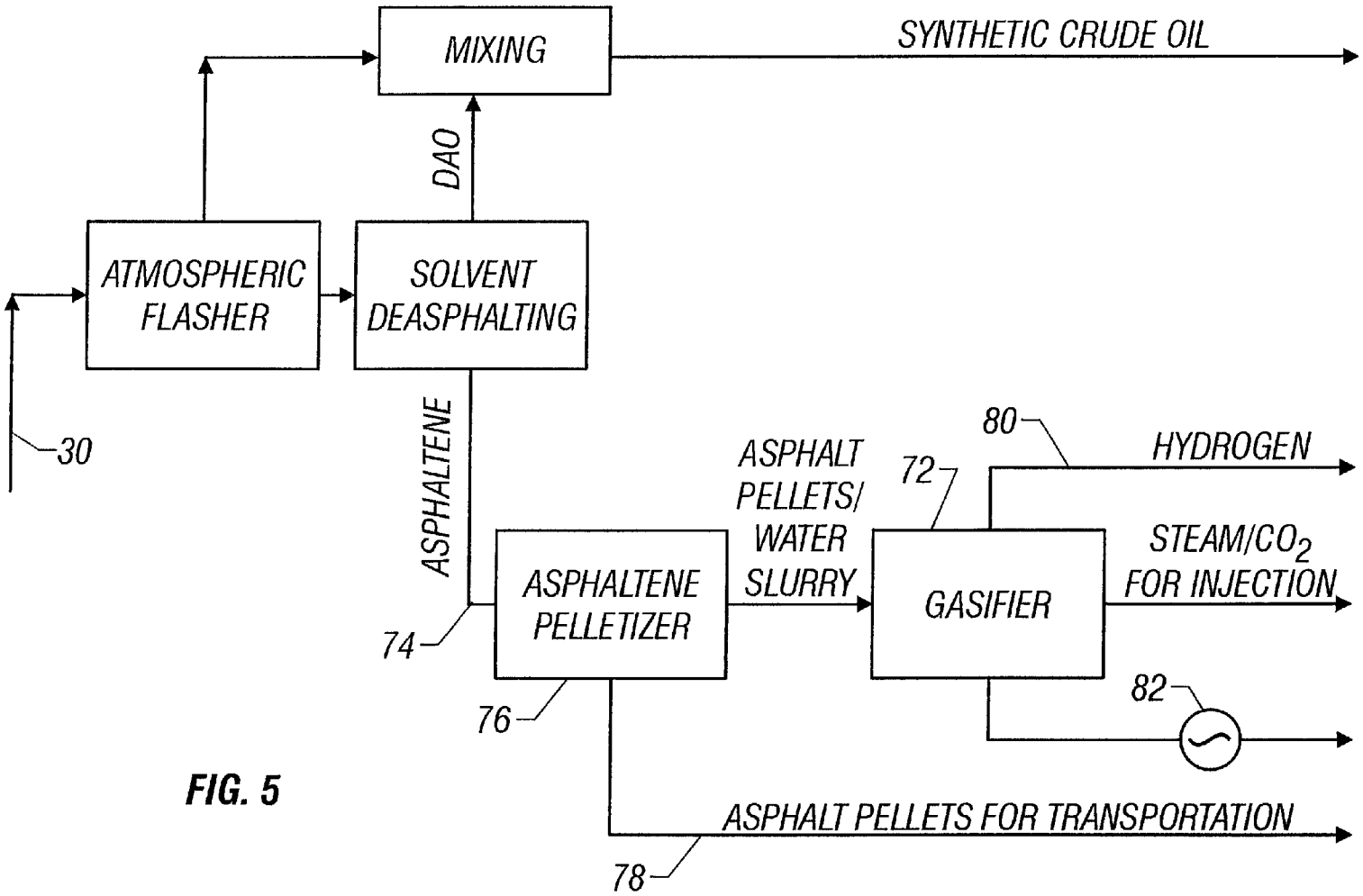
FIG. 5 is a schematic flow diagram of a heavy oil or bitumen production and processing scheme with steam generation for reinjection into the underground heavy oil or bitumen reservoir according to another alternate embodiment of the invention with a centralized asphaltene gasifier.

The configuration in FIG. 5 is similar to that of FIGS. 3–4, except that a conventional pressurized gasification unit 72 is employed in place of the CFB boilers, and the asphaltene fraction 74 is preferably pelletized and slurried in slurrying unit 76 to supply the water for temperature moderation in the gasification reactor (not shown). If desired, any asphaltene pellets 78 not required for gasification can be shipped to a remote location for combustion and/or gasification or other use, either as an aqueous slurry or as dewatered pellets. Steam is generated by heat exchange with the gasification reaction products, and $CO_2$ can also be recovered in a well-known manner for injection into the reservoir 10 with the steam. Hydrogen recovered in line 80 can be exported, for example, to a nearby refinery or synthesis unit for production of ammonia, alkyl alcohol or the like (not shown). Power can also be generated by expansion of the gasification reaction products and/or steam via turbine 82. This embodiment is exemplary of the versatility of the present invention for adapting the asphaltene combustion to different applications and situations other than combustion as a fuel.

Figure 6:
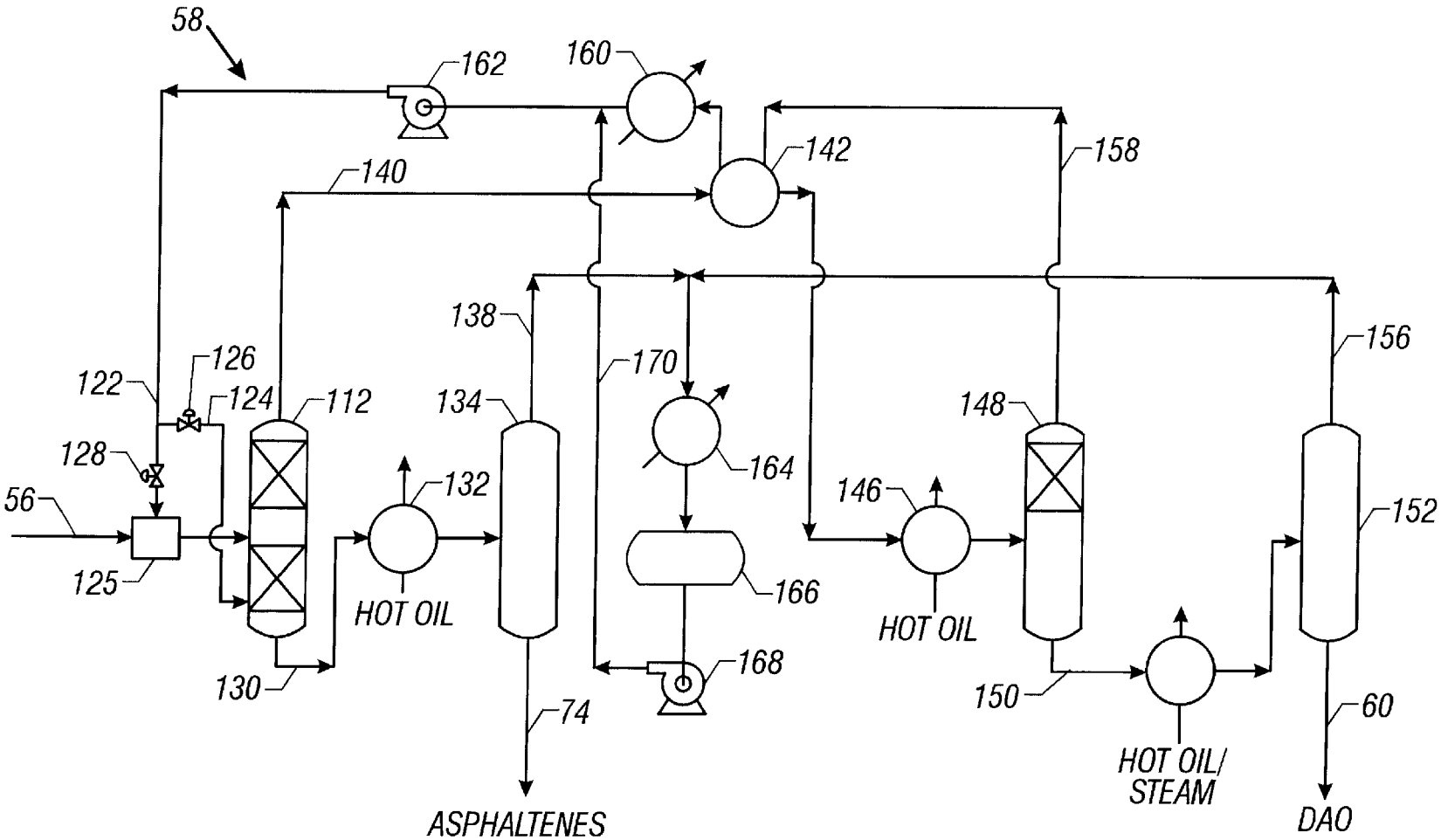
FIG. 6 is a schematic flow diagram of a typical on-site ROSE solvent deasphalting unit used in the heavy oil or bitumen processing according to the present invention.

With reference to FIG. 6 there is shown a preferred solvent deasphalting unit 58. The petroleum residue 56 is supplied to asphaltene separator 112. Solvent is introduced via lines 122 and 124 into mixer 125 and asphaltene separator 112, respectively. If desired, all or part of the solvent can be introduced into the feed line via line 122 as mentioned previously. Valves 126 and 128 are provided for controlling the rate of addition of the solvent into asphaltene separator 112 and mixer 125, respectively. If desired, the conventional mixing element 125 can be employed to mix in the solvent introduced from line 122.

The asphaltene separator 112 contains conventional contacting elements such as bubble trays, packing elements such as rings or saddles, structural packing such as that available under the trade designation ROSEMAX, or the like. In the asphaltene separator 112, the residue separates into a solvent/deasphalted oil (DAO) phase, and an asphaltene phase. The solvent/DAO phase passes upwardly while the heavier asphaltene phase travels downwardly through separator 112. As asphaltene solids are formed, they are heavier than the solvent/DAO phase and pass downwardly. The asphaltene phase is collected from the bottom of the asphaltene separator 112 via line 130, heated in heat exchanger 132 and fed to flash tower 134. The asphaltene phase is stripped of solvent in flash tower 134. The asphaltene is recovered as a bottoms product in line 74, and solvent vapor overhead in line 138.

The asphaltene separator 112 is maintained at an elevated temperature and pressure sufficient to effect a separation of the petroleum lo residuum and solvent mixture into a solvent/DAO phase and an asphaltene phase. Typically, asphaltene separator 112 is maintained at a sub-critical temperature of the solvent and a pressure level at least equal to the critical pressure of the solvent.

The solvent/DAO phase is collected overhead from the asphaltene separator 112 via line 140 and conventionally heated via heat exchanger 142. The heated solvent/DAO phase is next supplied directly to heat exchanger 146 and DAO separator 148.

As is well known, the temperature and pressure of the solvent/DAO phase is manipulated to cause a DAO phase to separate from a solvent phase. The DAO separator 148 is maintained at an elevated temperature and pressure sufficient to effect a separation of the solvent/DAO mixture into solvent and DAO phases. In the DAO separator 148, the heavier DAO phase passes downwardly while the lighter solvent phase passes upwardly. The DAO phase is collected from the bottom of the DAO separator 148 via line 150. The DAO phase is fed to flash tower 152 where it is stripped to obtain a DAO product via bottoms line 60 and solvent vapor in overhead line 156. Solvent is recovered overhead from DAO separator 148 via line 158, and cooled in heat exchangers 142 and 160 for recirculation via pump 162 and lines 122, 124. Solvent recovered from vapor lines 138 and 156 is condensed in heat exchanger 164, accumulated in surge drum 166 and recirculated via pump 168 and line 170.

The DAO separator 148 typically is maintained at a temperature higher than the temperature in the asphaltene separator 112. The pressure level in DAO separator 148 is maintained at least equal to the critical pressure of the solvent when maintained at a temperature equal to or above the critical temperature of the solvent. Particularly, the temperature level in DAO separator 148 is maintained above the critical temperature of the solvent and most particularly at least 50° F. above the critical temperature of the solvent.

Figure 7:
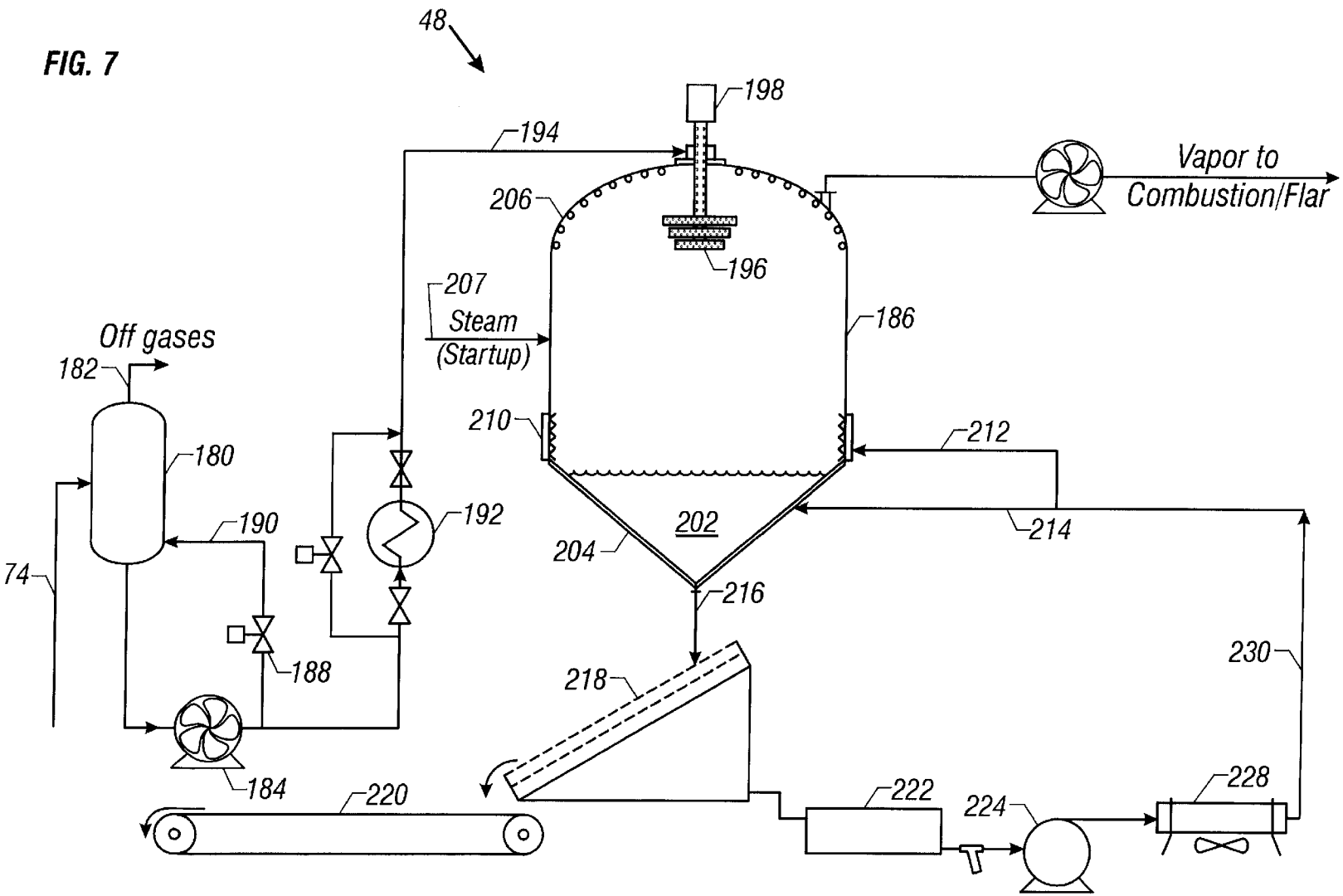
FIG. 7 is a schematic flow diagram of a typical on-site asphaltene pelletizer used in the heavy oil or bitumen processing/steam generation according to the present invention.

With reference to FIG. 7 there is shown a preferred pelletizing unit 48. The asphaltenes fraction 74 is fed to surge drum 180. The purpose of the surge drum 180 is to remove residual solvent contained in the asphaltenes 74 recovered from solvent deasphalting unit 58, which is vented overhead in line 182, and also to provide a positive suction head for pump 184. The pump 184 delivers the asphaltenes to the pelletizer vessel 186 at a desirable flow rate. A spill back arrangement, including pressure control valve 188 and return line 190, maintains asphaltenes levels in the surge drum 180 and also adjusts for the fluctuations in pellet production. The asphaltenes from the pump 184 flow through asphaltenes trim heater 192 where the asphaltenes are heated to the desired operating temperature for successful pelletization. A typical outlet temperature from the trim heater 192 ranges from about 350° to about 650° F., depending on the viscosity and R&B softening point temperature of the asphaltenes.

The hot asphaltenes flow via line 194 to the top of the pelletizer vessel 186 where they pass into the rotating prilling head 196. The rotating head 196 is mounted directly on the top of the pelletizer vessel 186 and is rotated using an electrical motor 198 or other conventional driver. The rotating head 196 is turned at speeds in the range of from about 100 to about 10,000 RPM.

Figure 8:
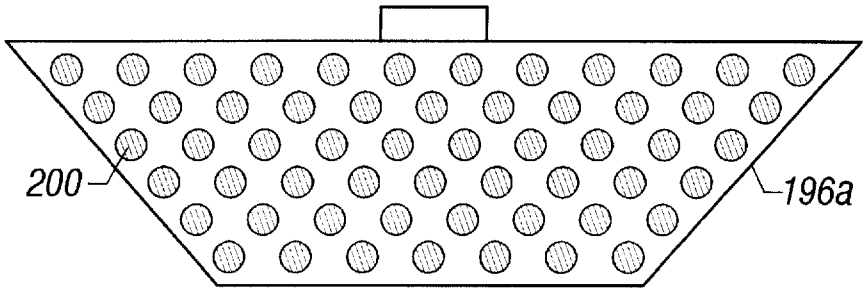
FIG. 8 is a perspective view of a rotating prilling head used in the pelletizer of FIG. 7.
Figure 9:
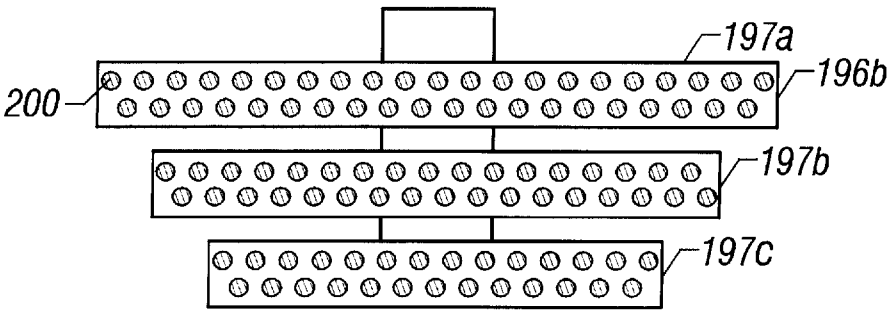
FIG. 9 is a perspective view of an alternate embodiment of a rotating prilling head used in the pelletizer of FIG. 7.

The rotating head 196 can be of varying designs including, but not limited to the tapered basket 196*a* or multiple diameter head 196b designs shown in FIGS. 8 and 9, respectively. The orifices 200 are evenly spaced on the circumference of the heads 196*a*,196*b* in one or more rows in triangular or square pitch or any other arrangement as discussed in more detail below. The orifice 200 diameter can be varied from about 0.03 to about 0.5 inch (about 0.8 to 12.5 mm) to produce the desired pellet size and distribution. The combination of the rotating head 196 diameter, the RPM, the orifice 200 size and fluid temperature (viscosity) controls the pellet size and size distribution, throughput per orifice and the throw-away diameter of the pellets. As the asphaltenes enter the rotating head 196, the centrifugal force discharges long, thin cylinders of the asphaltenes into the free space at the top of the pelletizer vessel 186. As the asphaltenes travel outwardly and/or downwardly through the pelletizer vessel 186, the asphaltenes break up into spherical pellets as the surface tension force overcomes the combined viscous and inertial forces. The pellets fall spirally into the cooling water bath 202 (see FIG. 7) which is maintained in a preferably conical bottom 204 of the pelletizer vessel 186. The horizontal distance between the axis of rotation of the rotating head 196 and the point where the pellet stops travelling away from the head 196 and begins to fall downwardly is called the throw-away radius. The throw-away diameter, i.e. twice the throw-away radius, is preferably less than the inside diameter of the pelletizing vessel 186 to keep pellets from hitting the wall of the vessel 186 and accumulating thereon.

Steam, electrical heating coils or other heating elements 206 may be provided inside the top section of the pelletizer vessel to keep the area adjacent the head 196 hot while the asphaltenes flow out of the rotating head 196. Heating of the area within the top section of the pelletizer vessel 186 is used primarily during startup, but can also be used to maintain a constant vapor temperature within the pelletizer vessel 186 during regular operation. If desired, steam can be introduced via line 207 to heat the vessel 186 for startup in lieu of or in addition to the heating elements 206. The introduction of steam at startup can also help to lo displace air from the pelletizer vessel 196, which could undesirably oxidize the asphaltene pellets. The maintenance of a constant vapor temperature close to the feed 194 temperature aids in overcoming the viscous forces, and can help reduce the throw-away diameter and stringing of the asphaltenes. The vapors generated by the hot asphaltene and steam from any vaporized cooling water leave the top of the vessel 186 through a vent line 208 and are recovered or combusted as desired.

The pellets travel spirally down to the cooling water bath 202 maintained in the bottom section of the pelletizer vessel 186. A water mist, generated by spray nozzles 210, preferably provides instant cooling and hardening of the surface of the pellets, which can at this stage still have a molten core. The surface-hardened pellets fall into the water bath 202 where the water enters the bottom section of the pelletizer vessel 186 providing turbulence to aid in removal of the pellets from the pelletizer vessel 186 and also to provide further cooling of the pellets. Low levels (less than 20 ppm) of one or more non-foaming surfactants from various manufacturers, including but not limited to those available under the trade designations TERGITOL and TRITON, may be used in the cooling water to facilitate soft landing for the pellets to help reduce flattening of the spherical pellets. The cooling water flow rate is preferably maintained to provide a temperature increase of from about 10° to about 50° F., more preferably from about 15° to about 25° F., between the inlet water supply via lines 212,214 and the outlet line 216.

The pellets and cooling water flow as a slurry out of the pelletizer vessel 186 to a separation device such as vibrating screen 218 where the pellets are dewatered. The pellets can have a water content up to about 10 weight percent, preferably as low as 1 or even 0.1 weight percent or lower. The pellets can be transported to a conventional silo, open pit, bagging unit or truck loading facility (not shown) by conveyer belt 220. The water from the dewatering screen 218 flows to water sump 222. The water sump 222 provides sufficient positive suction head to cooling water pump 224. The water can alternatively be drawn directly to the pump suction from the dewatering screen (not shown). The cooling water is pumped back to the pelletizer through a solids removal element 226 such as, for example, a filter where fines and solids are removed. The cooling water is cooled to ambient temperature, for example, by an air cooler 228, by heat exchange with a cooling water system (not shown), or by other conventional cooling means, for recirculation to the pelletization vessel 186 via line 230.

Typical operating conditions for the preferred pelletizer 48 of FIG. 7 for producing a transportable, flowable asphaltene pellet product are as shown in Table 1 below:

TABLE 1

Typical Pelletizer Operating Conditions

| Condition | Range | Preferred Range |
|---|---|---|
| Asphaltene feed temperature | 350° to 700° F. | 400 to 600° F. |
| Pressure | 1 atmosphere to 200 psig | Less than 50 psig |
| Head Diameter, in. | 2 to 60 | 2 to 60 |
| Head RPM | 100 to 10,000 | 200 to 5000 |
| Orifice Size, in. | 0.03 to 0.5 | Less than 0.5 |
| Orifice Pitch | Triangular or square | |
| Orifice capacity | 1 to 1000 lbs/hr per orifice | Up to 400 lbs/hr per orifice |
| Throw-away diameter | 1 to 15 feet | 2 to 10 feet |
| Cooling water in, ° F. | 40 to 165 | 60 to 140 |
| Cooling water out, ° F. | 70 to 190 | 75 to 165 |
| Cooling water ΔT, ° F. | 10 to 50 | 15 to 25 |
| Pellet size, mm | 0.1 to 5 | 0.5 to 3 |

The centrifugal extrusion device 196 results in a low-cost, high-throughput, flexible and self-cleaning device to pelletize the asphaltenes. The orifices 200 are located on the circumference of the rotating head 196. The number of orifices 200 required to achieve the desired production is increased by increasing the head 196 diameter and/or by decreasing the distance between the orifices 200 in a row and axially spacing the orifices 200 at multiple levels. The orifices 200 can be spaced axially in triangular or square pitch or another configuration.

The rotating head 196 can be of varying designs including, but not limited to the tapered basket 196*a* or multiple diameter head design 196*b* shown in FIGS. 8 and 9, respectively. The combination of the head 196 diameter and the speed of rotation determine the centrifugal force at which the asphaltenes extrudes from the centrifugal head 196. By providing orifices 200 at different circumferences of the head 196*b*, for example, it is believed that any tendency for collision of molten/sticky particles is minimized since there will be different throw-away diameters, thus inhibiting agglomeration of asphaltenes particles before they can be cooled and solidified. If desired, different rings 197*a–c* in the head 196*b* can be rotated at different speeds, e.g. to obtain about the same centrifugal force at the respective circumferences.

Besides speed of rotation and diameter of the head 196, the other operating parameters are the orifice 200 size, asphaltenes temperature, surrounding temperature, size of the asphaltenes flow channels inside the head 200 (not shown), viscosity and surface tension of the asphaltenes. These variables and their relation to the pellet size, production rate per orifice, throw-away diameter and the jet breaking length are explained below.

The orifice 200 size affects the pellet size. A smaller orifice 200 size produces smaller pellets while a larger size produces larger pellets for a given viscosity (temperature), speed of rotation, diameter of the head 196 and throughput. The throw-away diameter increases with a decrease in orifice 200 size for the same operating conditions. Adjusting the speed of rotation, diameter of the head 196 and throughput, the pellets can be produced with a varied range of sizes. Depending on the throughput, the number of orifices 200 can be from 10 or less to 700 or more.

The speed of rotation and diameter of the centrifugal head 196 affect the centrifugal force at which the extrusion of the asphaltenes takes place. Increasing the RPM decreases the pellet size and increases the throw-away diameter, assuming other conditions remain constant. Increase in head 196 diameter increases the centrifugal force, and to maintain constant centrifugal force, the RPM can be decreased proportionally to the square root of the ratio of the head 196 diameters. For a higher production rate per orifice 200, greater speed of rotation is generally required. The typical RPM range is 100 to 10,000. The centrifugal head 196 diameter can vary from 2 inch to 5 feet in diameter.

The viscosity of the asphaltenes generally increases exponentially with a decrease in temperature. The asphaltenes viscosities at various temperatures can be estimated by interpolation using the ASTM technique known to those skilled in the art, provided viscosities are known at two temperatures. The viscosity affects the size of the pellets produced, the higher viscosity of the asphaltenes producing larger pellets given other conditions remain constant.

When a slurry of the asphaltenes is desired, e.g. for gasification, the pelletizer 48 is operated as a slurrying unit. The operating conditions are adjusted to produce finer particles, e.g. by rotating the prilling head 196 at a higher RPM. Also, the slurry recovered via line 216 can be recovered directly, without pellet dewatering or water recycle. Preferably, the slurrying unit is operated with water supplied once-through so that the slurry has the desired solids content, typically 50–80 weight percent solids, particularly 60–70 weight percent solids. If desired, the water content in the slurry 216 can be adjusted by adding or removing water as desired. A dispersant can also be added to the slurry. Typical operating conditions for the pelletizer 48 to produce a slurry are given below in Table 2.

TABLE 2

Typical Slurrying Unit Operating Conditions

| Condition | Range | Preferred Range |
|---|---|---|
| Resid feed temperature | 350° to 700° F. | 400 to 600° F. |
| Pressure | 1 atmosphere to 200 psig | Less than 50 psig |
| Head Diameter, in. | 2 to 60 | 6 to 36 |
| Head RPM | 10 to 10,000 | 500 to 10,000 |
| Orifice Size, in. | 0.03 to 1 | Less than 0.5 |
| Orifice Pitch | Triangular or square | |
| Orifice capacity | 1 to 1000 lbs/hr per orifice | Up to 400 lbs/hr per orifice |
| Throw-away diameter | 2 to 15 feet | 4 to 15 feet |
| Cooling water in, ° F. | 40 to 165 | 60 to 140 |
| Cooling water out, ° F. | 70 to 190 | 75 to 165 |
| Cooling water ΔT, ° F. | 10 to 150 | 15 to 100 |
| Particle size, mm | 0.01 to 1 | 0.015 to 0.05 |

It is seen that the above-described invention achieves substantial economic and operational advantages over the prior art. The synthetic crude has a higher value than the heavy oil or bitumen. The synthetic crude can also be transported by pipeline because it has a lower viscosity (4–5° API improvement), thereby eliminating the expense and complication of supplying diluent to the production area. The low-value asphaltene fraction which contains most of the sulfur and nitrogen compounds as well as the metals is burned to supply the heat for raising the injection steam. The invention thus achieves a synergistic integration of upstream and downstream processes at the production field.

What is claimed is:

1. A process for recovering a pumpable crude oil from a subterranean reservoir of heavy oil or bitumen, comprising the steps of:

(a) injecting steam through one or more injection wells completed in communication with the reservoir to mobilize the heavy oil or bitumen;

(b) producing the mobilized heavy oil or bitumen from at least one production well completed in the reservoir;

(c) fractionating the heavy oil or bitumen produced from step (b) at a location adjacent to the reservoir into a first fraction as a minor amount of the heavy crude comprising a gas oil fraction and second fraction comprising a residue;

(d) solvent deasphalting the second fraction of the heavy oil or bitumen produced from step (c) to form an asphaltene fraction and a deasphalted oil fraction essentially free of asphaltenes;

(e) combusting the asphaltene fraction from step (d) to produce the steam for injection step (a);

(f) blending the first fraction from step (c) with the deasphalted oil fraction from step (d) to form a pumpable synthetic crude oil; and (g) pipelining the synthetic crude oil to a location remote from the reservoir.

2. The process of claim 1 wherein the fractionation step (c) comprises essentially atmospheric fractionation.

3. The process of claim 1 wherein the asphaltene fraction from step (d) is supplied as a liquid to the combustion step (e).

4. The process of claim 1 comprising the step of pelletizing the asphaltene fraction from step (d) to obtain asphaltene pellets for supply to the combustion step (e).

5. The process of claim 1 wherein the combustion step (e) comprises combustion in at least one boiler to produce the injection steam for step (a).

6. The process of claim 5 comprising performing the solvent deasphalting step (d) at a first location and transporting the asphaltene fraction from the first location to a plurality of boilers spaced away from the first location adjacent to the one or more injection wells.

7. The process of claim 5 wherein the at least one boiler comprises a circulating fluid bed boiler.

8. The process of claim 1 wherein the combustion step (e) comprises gasification of the asphaltenes fraction to produce a synthesis gas and the injection steam for step (a).

9. The process of claim 8 comprising the steps of recovering $CO_2$ from the synthesis gas and injecting the $CO_2$ into the reservoir with the steam.

10. The process of claim 8 wherein steam produced from gasification is expanded in a turbine to generate electricity.

11. A system for producing a pumpable synthetic crude oil, comprising:

a subterranean reservoir of heavy oil or bitumen;

at least one injection well completed in the reservoir for injecting steam into the reservoir to mobilize the heavy oil or bitumen;

at least one production well completed in the reservoir for producing the mobilized heavy oil or bitumen;

an atmospheric flash unit for fractionating the heavy oil or bitumen produced from the at least one production well into a minor portion comprising a gas oil fraction and a major portion comprising a residue fraction;

a solvent deasphalting unit for separating the residue fraction into a minor portion comprising an asphaltene fraction and a major portion comprising a deasphalted oil fraction essentially free of asphaltenes;

mixing apparatus for mixing the gas oil fraction and the deasphalted oil fraction to form a pumpable synthetic crude;

at least one boiler for combustion of the asphaltene fraction to generate the injection steam;

at least one line for supplying the steam from the at least one boiler to the at least one injection well.

12. The system of claim 11 further comprising a line for supplying the asphaltene fraction in liquid form to the at least one boiler.

13. The system of claim 11 wherein the atmospheric flash unit and the solvent deasphalting unit are centrally located and a plurality of boilers are located away from the central location adjacent to the at least one injection well.

14. A system for producing a pumpable synthetic crude oil, comprising:

a subterranean reservoir of heavy oil or bitumen;

at least one injection well completed in the reservoir for injecting steam into the reservoir to mobilize the heavy oil or bitumen;

at least one production well completed in the reservoir for producing the mobilized heavy oil or bitumen;

an atmospheric flash unit for fractionating the heavy oil or bitumen produced from the production well into a minor portion comprising a gas oil fraction and a major portion comprising a residue fraction;

a solvent deasphalting unit for separating the residue fraction into a minor portion comprising an asphaltene fraction and a major portion comprising a deasphalted oil fraction essentially free of asphaltenes;

mixing apparatus for mixing the gas oil fraction and the deasphalted oil fraction to form a pumpable synthetic crude;

a slurrying unit for pelletizing the asphaltene fraction and forming an aqueous slurry thereof;

a gasification unit for partial oxidation of the slurry to form a synthesis gas and generating steam;

at least one line for supplying the steam from the gasification reactor to the at least one injection well.

15. The system of claim 14 wherein the slurrying unit comprises:

an upright prilling vessel having an upper prilling zone, a hot discharge zone below the prilling zone, a cooling zone below the discharge zone, and a lower cooling bath below the cooling zone;

a centrally disposed prilling head in the prilling zone rotatable along a vertical axis and having a plurality of discharge orifices for throwing asphaltene radially outwardly, wherein a throw-away diameter of the prilling head is less than an inside diameter of the prilling vessel;

a line for supplying a hot, liquid asphaltene stream comprising the asphaltene fraction to the prilling head;

a vertical height of the discharge zone sufficient to allow asphaltene discharged from the prilling head to form into liquid droplets;

nozzles for spraying water inwardly into the cooling zone to cool and at least partially solidify the liquid droplets to be collected in the bath and form a slurry of solidified asphaltene particles in the bath;

a line for supplying water to the nozzles and the bath to maintain a depth of the bath in the prilling vessel;

a line for withdrawing the slurry of the asphaltene particles in the bath water from the prilling vessel.

16. The system of claim 15 wherein the slurrying unit comprises a liquid-solid separator for dewatering pellets from the slurry.

17. The system of claim 14 wherein the atmospheric fractionator unit, the solvent deasphalting unit, the slurrying unit and the gasification unit are centrally located and a plurality of steam supply lines carry steam to a plurality of injection wells located away from the central location.

18. The system of claim 17 wherein $CO_2$ is generated by and recovered from the gasification unit, and further comprising at least one line for supplying the $CO_2$ from the gasification unit to the at least one injection well.

19. The system of claim 14 further comprising a turbine for expanding a portion of the steam generated by the gasification unit to generate electricity.

20. A process for recovering a pumpable crude oil from a subterranean reservoir of heavy oil or bitumen, comprising the steps of:

(a) injecting steam through one or more injection wells completed in communication with the reservoir to mobilize the heavy oil or bitumen;

(b) producing the mobilized heavy oil or bitumen from at least one production well completed in the reservoir;

(c) solvent deasphalting at least a portion of the heavy oil or bitumen produced from step (b) to form an asphaltene fraction and a deasphalted oil fraction essentially free of asphaltenes;

(d) pelletizing the asphaltene fraction from step (c) to obtain asphaltene pellets;

(e) combusting the asphaltene pellets from step (d) to produce the steam for injection step (a).

21. The process of claim 20 wherein the combustion step (e) comprises combustion in at least one boiler to produce the injection steam for step (a).

22. The process of claim 21 comprising performing the solvent deasphalting step (d) at a first location and transporting the asphaltene fraction from the first location to a plurality of boilers spaced away from the first location adjacent to the one or more injection wells.

23. The process of claim 21 wherein the at least one boiler comprises a circulating fluid bed boiler.

24. The process of claim 20 wherein the combustion step (e) comprises gasification of the asphaltene pellets to produce a synthesis gas and the injection steam for step (a).

25. The process of claim 24 comprising the steps of recovering $CO_2$ from the synthesis gas and injecting the $CO_2$ into the reservoir with the steam.

26. The process of claim 24 wherein a portion of steam generated from gasification is expanded in a turbine to generate electricity.

27. A system for producing a pumpable synthetic crude oil, comprising:

a subterranean reservoir of heavy oil or bitumen;

at least one injection well completed in the reservoir for injecting steam into the reservoir to mobilize the heavy oil or bitumen;

at least one production well completed in the reservoir for producing the mobilized heavy oil or bitumen;

an atmospheric flash unit for fractionating the heavy oil or bitumen produced from the at least one production well into a minor portion comprising a gas oil fraction and a major portion comprising a residue fraction;

a solvent deasphalting unit for separating the residue fraction into a minor portion comprising an asphaltene fraction and a major portion comprising a deasphalted oil fraction essentially free of asphaltenes;

mixing apparatus for mixing the gas oil fraction and the deasphalted oil fraction to form a pumpable synthetic crude;

a pelletizer for pelletizing the asphaltene fraction into solid pellets;

at least one boiler for combustion of the asphaltene pellets to generate the injection steam;

at least one line for supplying the steam from the at least one boiler to the at least one injection well.

28. The system of claim 27 wherein the pelletizer comprises:

an upright pelletizing vessel having an upper prilling zone, a sphere-forming zone below the prilling zone, a cooling zone below the sphere-forming zone, and a lower aqueous cooling bath below the cooling zone;

a centrally disposed prilling head in the prilling zone rotatable along a vertical axis and having a plurality of discharge orifices for throwing asphaltene radially outwardly, wherein a throw-away diameter of the prilling head is less than an inside diameter of the pelletizing vessel;

a line for supplying the asphaltene fraction in liquid form to the prilling head;

a vertical height of the sphere-forming zone sufficient to allow asphaltene discharged from the prilling head to form substantially spherical liquid pellets;

nozzles for spraying water inwardly into the cooling zone to cool and at least partially solidify the liquid pellets to be collected in the bath;

a line for supplying water to the nozzles and the bath to maintain a depth of the bath in the pelletizing vessel;

a line for withdrawing a slurry of the pellets in the bath water;

a liquid-solid separator for dewatering the pellets from the slurry.

29. A process for recovering a pumpable crude oil from a subterranean reservoir of heavy oil or bitumen, comprising the steps of:

(a) injecting steam through one or more injection wells completed in communication with the reservoir to mobilize the heavy oil or bitumen;

(b) producing the mobilized heavy oil or bitumen from at least one production well completed in the reservoir;

(c) solvent deasphalting a first portion of the heavy oil or bitumen at a location adjacent to the reservoir to form an asphaltene fraction and a deasphalted oil fraction essentially free of asphaltenes;

(d) combusting the asphaltene fraction from step (c) to produce the steam for injection step (a);

(e) blending a second portion of the heavy oil or bitumen with the deasphalted oil fraction from step (c) to form a pumpable synthetic crude oil; and (g) pipelining the synthetic crude oil to a location remote from the reservoir.

* * * * *